US007970099B2

(12) United States Patent
Fadler

(10) Patent No.: US 7,970,099 B2
(45) Date of Patent: Jun. 28, 2011

(54) MULTI-BEAM X-RAY DEVICE

(75) Inventor: Franz Fadler, Hetzles (DE)

(73) Assignee: Siemens Aktiengesellschaft, Munich (DE)

( * ) Notice: Subject to any disclaimer, the term of this patent is extended or adjusted under 35 U.S.C. 154(b) by 50 days.

(21) Appl. No.: 12/572,391

(22) Filed: Oct. 2, 2009

(65) Prior Publication Data

US 2010/0091938 A1 Apr. 15, 2010

(30) Foreign Application Priority Data

Oct. 2, 2008 (DE) ..... 10 2008 050 352

(51) Int. Cl.
*H05G 1/60* (2006.01)
*H01J 35/08* (2006.01)
*G21K 1/04* (2006.01)

(52) U.S. Cl. ..... 378/21; 378/124; 378/150

(58) Field of Classification Search ..... 378/4, 9, 378/16, 122, 136, 143, 145–153
See application file for complete search history.

(56) References Cited

U.S. PATENT DOCUMENTS

| | | | | |
|---|---|---|---|---|
| 4,489,426 | A * | 12/1984 | Grass et al. | 378/150 |
| 6,980,627 | B2 | 12/2005 | Qiu et al. | |
| 7,192,031 | B2 * | 3/2007 | Dunham et al. | 378/122 |
| 7,359,484 | B2 * | 4/2008 | Qiu et al. | 378/122 |
| 2008/0101545 | A1 | 5/2008 | Petrik | |

* cited by examiner

*Primary Examiner* — Irakli Kiknadze
(74) *Attorney, Agent, or Firm* — Schiff Hardin LLP

(57) ABSTRACT

A multi-beam x-ray device has a multi-beam x-ray tube in the form of a polygon, wherein the focal spots of the x-ray radiation are arranged along the polygon sides. An x-ray tube control unit controls the x-ray radiation emission such that an x-ray beam is alternately emitted from each polygon side in a specified sequence. Multiple first diaphragms with at least one respective first diaphragm aperture are arranged such that they can move into the beam path of the x-ray tube. A first diaphragm, whose first diaphragm aperture limits the cross section of the x-ray beam emitted from the x-ray tube, is associated with every polygon side. A number of slice images can be generated from different directions without a movement of the x-ray tube.

7 Claims, 4 Drawing Sheets

MULTI-BEAM X-RAY DEVICE

BACKGROUND OF THE INVENTION

1. Field of the Invention

The present invention concerns a multi-beam x-ray device of the type having multi-beam x-ray tube and a diaphragm arrangement for fast acquisition of a plurality of x-ray images.

2. Description of the Prior Art

Conventional x-ray tubes are essentially composed of a vacuum chamber with housing in which a cathode and an anode are enclosed. The cathode acts as a negative electrode that emits the electrons toward the positive anode. The electrons are attracted from the anode and strongly accelerated by an electrical field between anode and cathode. The anode typically is formed of a metal, for example tungsten, molybdenum or palladium. When the electrons bombard the anode, their energy is for the most part converted into heat. Only a fraction of the kinetic energy can be converted into x-ray photons that are emitted by the anode in the form of an x-ray beam. The x-ray beam that is generated in such a manner exits the vacuum chamber through a radiation-permeable window made of a material with low atomic number.

Applications in industrial and medical imaging and for therapeutic treatments are unimaginable without x-ray tubes. All imaging methods with x-rays utilize the fact that different materials absorb x-rays differently. Conventional x-ray imaging methods generate a two-dimensional projection of a three-dimensional projection of a three-dimensional subject. The spatial resolution along the propagation direction of the x-ray beam is thereby lost.

Although it is also based on the different x-ray absorption properties of different materials, computed tomography offers a different form of imaging known as a slice image method. In computed tomography multiple x-ray images of a subject are generated from different directions and the lost volume information is subsequently reconstructed from these multiple images using a technique known as a back-projection method. Normally these 3D reconstructions are assembled from individual slices that proceed transverse to the subject. In this way a density can be determined for every volume element of the subject (known as a voxel, which corresponds to a three-dimensional pixel). A 3D image inside the subject can therefore be generated from all voxels.

In order to generate the multiple different slice images in computed tomography, an x-ray tube emitting the x-rays and an x-ray detector receiving the x-rays after exposure of the subject are moved around the subject. The mechanical movement is complicated and also occupies valuable examination time in medical technology. Various approaches have therefore been developed in order to be able to emit multiple different radiation beams from an x-ray tube. It is the goal to generate many slice images with different observation angles without mechanically moving the x-ray tube and the x-ray detector.

The PCT Application WO 25 2004/110111 A2 specifies a promising solution. A multi-beam x-ray tube with a stationary field emission cathode and an opposite anode are disclosed by this. The cathode comprises a plurality of stationary, individually controllable electron-emitting pixels that are distributed in a predetermined pattern on the cathode. The anode has a number of focal spots that are arranged in a predetermined pattern that is executed corresponding to the pattern of the pixels. A vacuum chamber encloses the anode and cathode. In one development, the cathode comprises carbon nanotubes.

The solution disclosed in WO 2004/110111 A2 offers many advantages relative to conventional thermionic x-ray radiation sources. It eliminates the heating element of the anode, operates at room temperature, generates pulsed x-ray radiation with a high repetition rate and generates plurality of beams with different focal spots.

In order to be able to use multi-beam x-ray tubes in medical technology, for example for a tomosynthesis in mammography, numerous adaptations are required. Among other things, it must be ensured that the radiation exposure of patients is minimized, the scatter radiation is reduced and the image series frequency is increased.

SUMMARY OF THE INVENTION

An object of the invention is to provide a multi-beam x-ray tube and a method to operate this via which a multi-beam x-ray tube can also be used in medical technology.

In accordance with the invention, a multi-beam x-ray device has a multi-beam x-ray tube fashioned in the form of a polygon, wherein the focal spots of the x-ray radiation are arranged along the polygon sides. The device also includes an x-ray tube control unit that controls the x-ray radiation emission such that an x-ray beam is alternately emitted from each polygon side in a specified sequence, and multiple diaphragms, each having at least one diaphragm aperture therein, are arranged such that they can move into the beam path of the x-ray tube. A diaphragm, whose first diaphragm aperture limits the cross section of the x-ray beam emitted from the x-ray tube, is associated with every polygon side. The advantage of the device is that a number of slice images can be generated from different directions without a movement of the x-ray tube.

In an embodiment, the diaphragm aperture can overlay the x-ray beam on an x-ray image receiver that does not vary its position relative to the multi-beam x-ray tube. Both x-ray tube and x-ray image receiver thereby do not have to be moved between acquisitions from different directions.

In a further embodiment, the diaphragms can be controlled such that that the diaphragm through whose diaphragm aperture an x-ray beam is currently passing is located at rest while the other first diaphragms move in the direction of a new focal spot position. It is advantageous that the x-ray image series frequency can advantageously be increased without having to increase the travel speed of the first diaphragm.

Furthermore, diaphragms may be first diaphragms with at least two first diaphragm apertures in the first diaphragms, and the device has second diaphragms also associated with the polygon sides. At least one first diaphragm aperture, through which no x-ray radiation is currently passing, is covered by the associated second diaphragm. This offers the advantage that unwanted x-ray scatter radiation is effectively suppressed.

The focal spots can advantageously have a regular interval from one another, and the separation of the first diaphragm apertures of the first diaphragm relative to one another can be n.5 times the interval of the focal spots, wherein $n \in N$ and N is the number of focal spots. The travel paths of the first diaphragm thus can be minimized.

In another embodiment, the polygon can be a regular, planar polygon. This offers the advantage of a simple mechanical and control-related realization.

In a further advantageous embodiment of the invention, a mammography system for tomosynthesis has a multi-beam x-ray device according to the invention. A plurality of x-ray images of the female breast can thereby be generated in a very fast series.

DESCRIPTION OF THE PREFERRED EMBODIMENTS

Figures 1, 5:
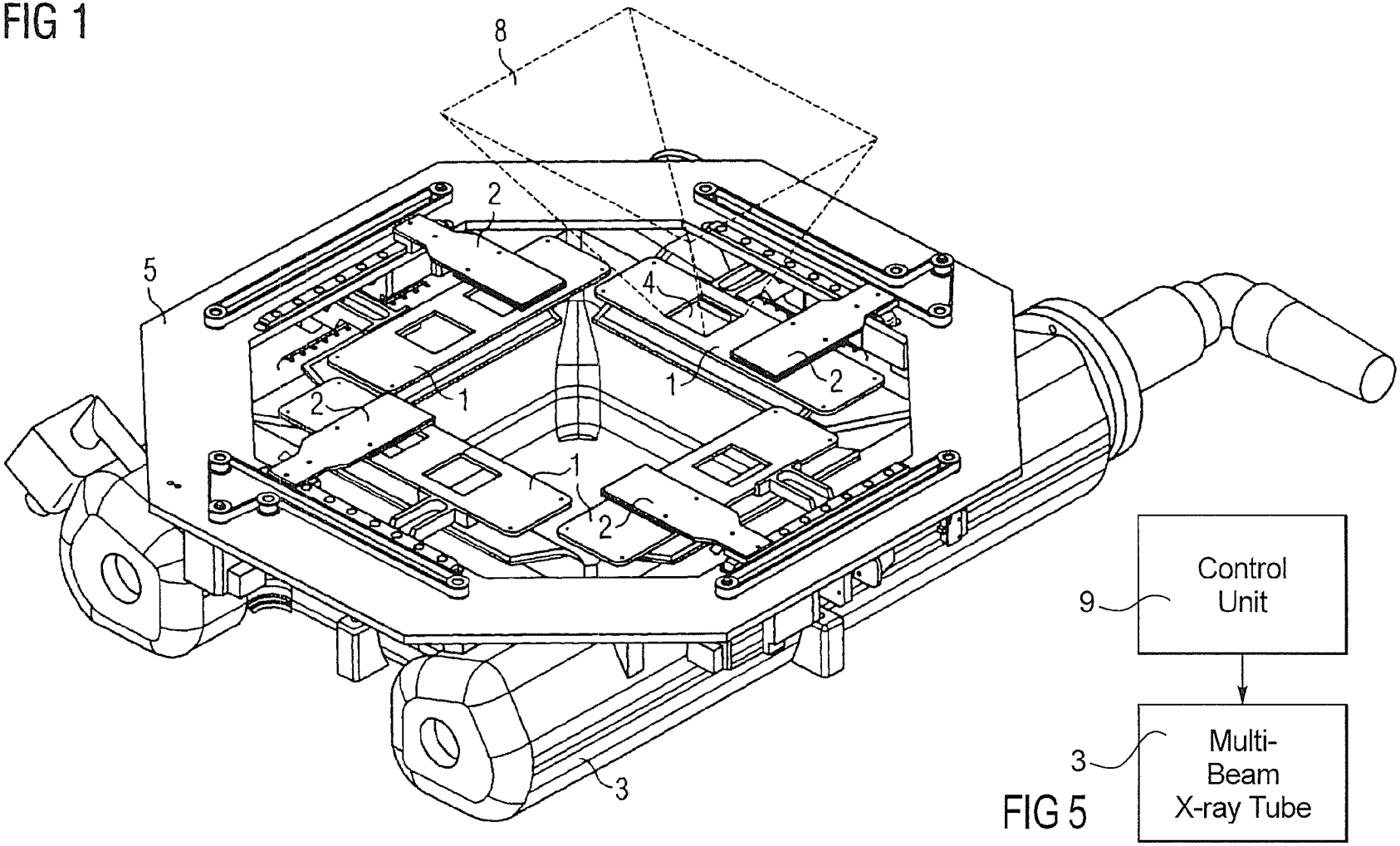
FIG. 1 is a perspective view of a multi-beam x-ray device in accordance with the invention.
FIG. 5 schematically shows the multi-beam x-ray tube in accordance with the invention, operated by a control unit.

FIG. 1 shows an overview of an arrangement according to the invention. A multi-beam x-ray tube 3 is in the shape of a square. The tube 3 can emit a number of x-rays beams respectively from different focal spots in an approximately vertical manner upwardly. One of these x-ray beams 8 is designated with its boundaries in FIG. 1. An x-ray control unit 9 shown in FIG. 5 regulates the emission of the x-ray radiation. Normally an x-ray beam is only emitted from one focal spot at a time. The focal spots are located along the sides of the square and are arranged at regular intervals. In order to limit the cross section of the x-ray beam 8, a first diaphragm 1 is required. The cross section of the x-ray beam 8 is limited in its dimensions by a first diaphragm aperture 4 in the first diaphragm 1. A second diaphragm 2 covers a second first diaphragm aperture 4 that is not used. The covering prevents the escape of scatter radiation. The first and second diaphragms 1, 2 are connected with an octagonal diaphragm support 5 such that they can move. As different focal spots are activated in a specified succession by the x-ray control unit, the arrangement of the first and second diaphragms 1, 2 must correspondingly "migrate" as well.

Figure 2:
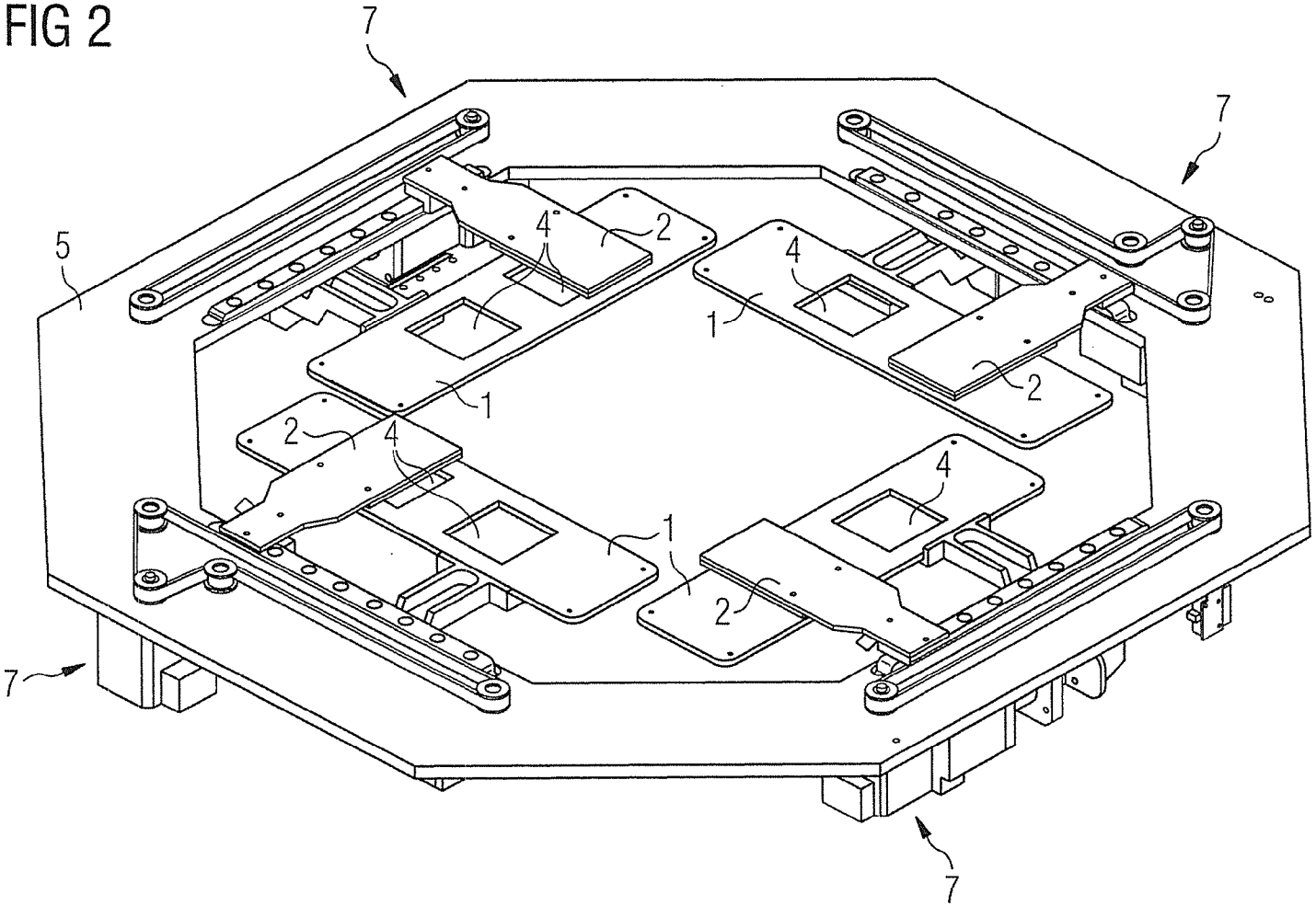
FIG. 2 is a perspective view of a diaphragm arrangement in the device of FIG. 1, as seen from above.
Figure 3:
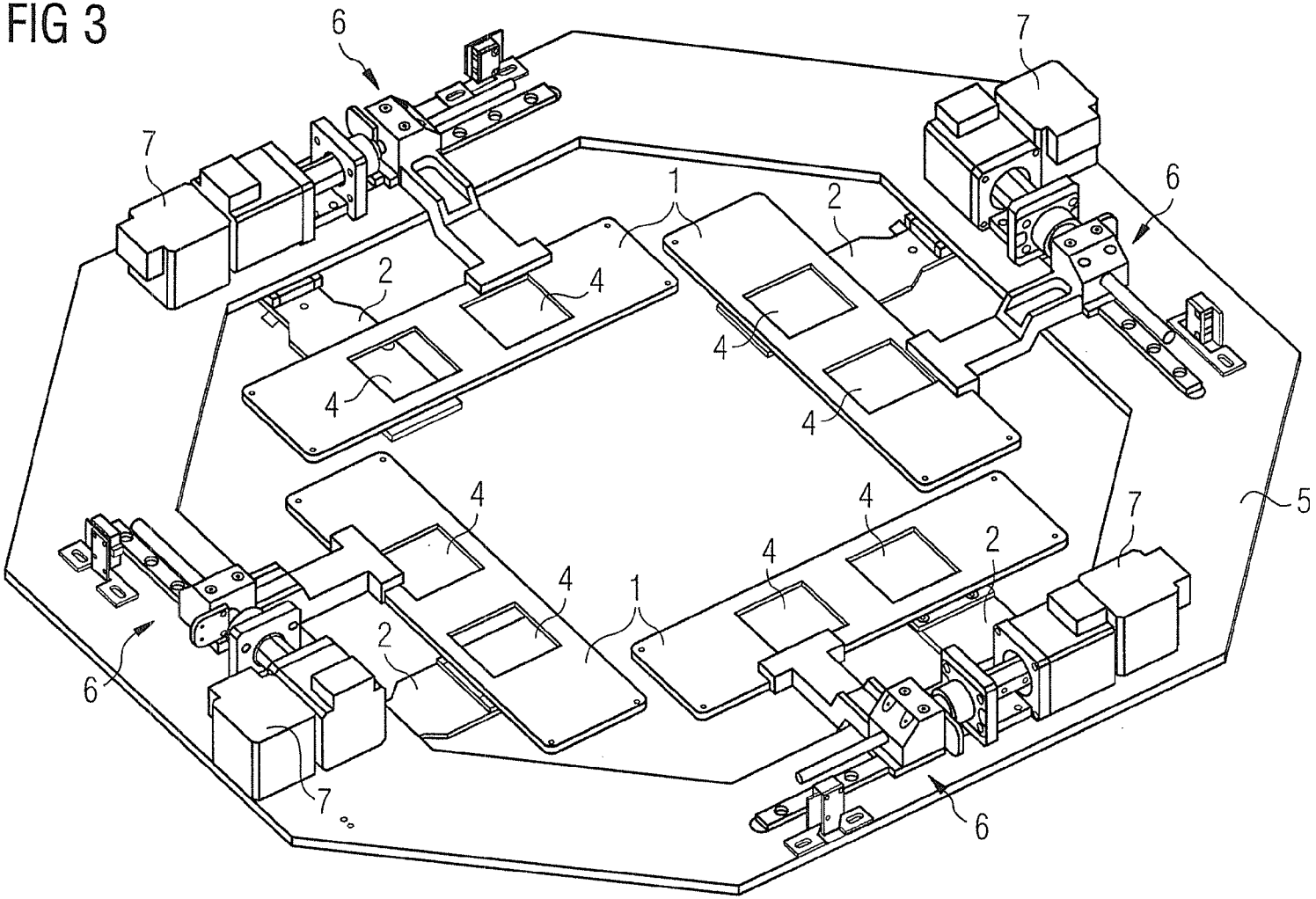
FIG. 3 is a perspective view of a diaphragm arrangement in the device of FIG. 1, as seen from below.

In a perspective view, FIGS. 2 and 3 show the diaphragm support 5 with the first and second diaphragms 1, 2 from FIG. 1 without the multi-beam x-ray tube. FIG. 2 shows the diaphragm arrangement from above, FIG. 3 from below. The synchronous belt drives 7 are also recognizable in FIG. 2. These move the second diaphragms 2 into the positions above the unnecessary first diaphragm apertures 4. Since the second diaphragms 2 are fashioned larger than the first diaphragm apertures 4, the precision of the movement of the second diaphragms 2 does not play a large role. It is important that a movement between the two first diaphragm apertures 4 of a first diaphragm 1 can ensue very quickly. To differentiate the beam emissions, the actuation of the first diaphragms 1 must be very exact since their position determines the cross section of the x-ray beam and the orientation of the x-ray image on an x-ray image receiver. Such exact positioning is facilitated by the travel paths between the focal spots not being so large. In this case a relatively slow, but very precise spindle drive 6 is therefore used as shown in FIG. 3. The first diaphragms 1 are arranged in different planes relative to one another so that they cannot contact or, respectively, obstruct each other upon movement.

Figure 4:
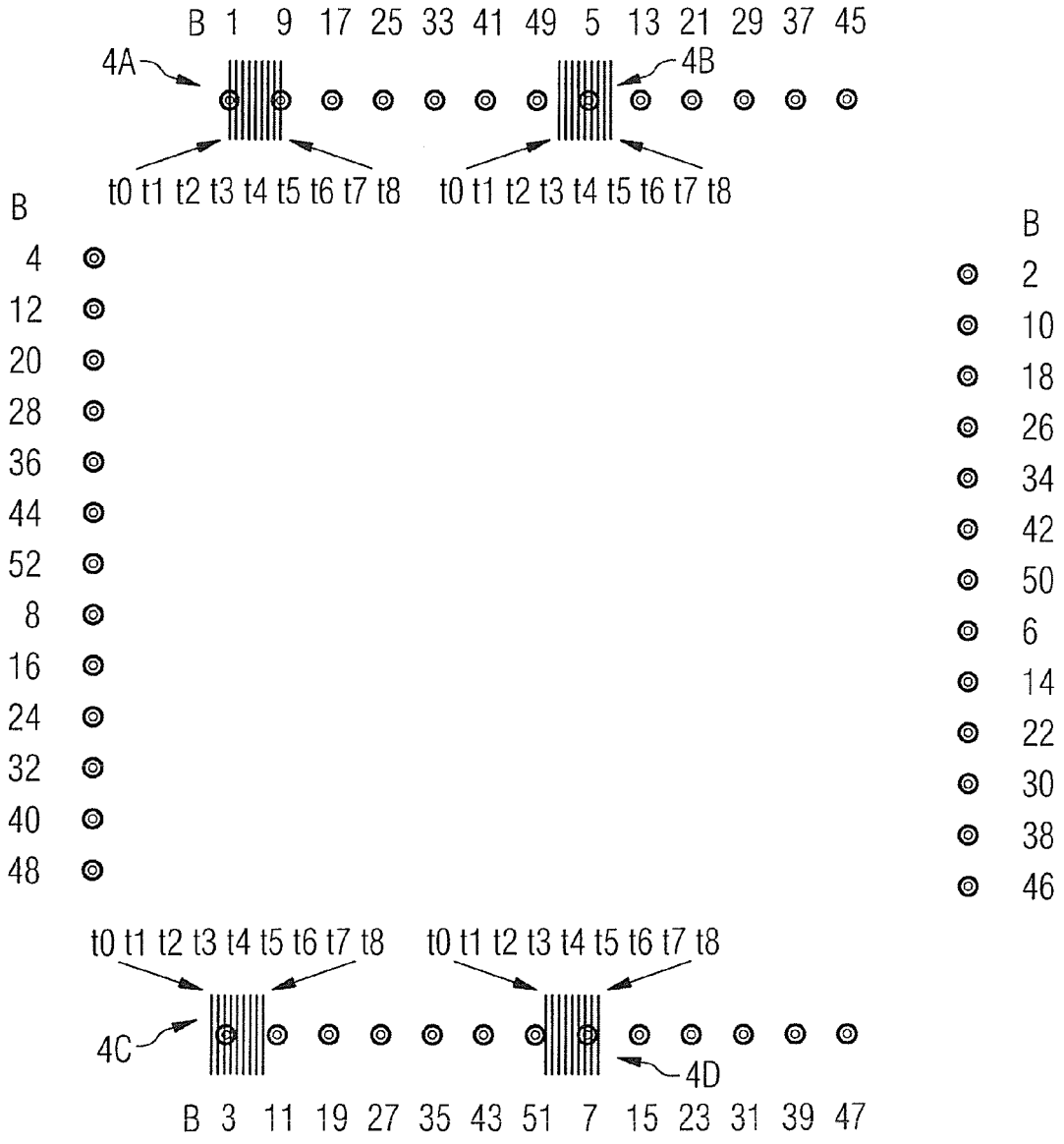
FIG. 4 is an example of a focal spot arrangement with associated diaphragm arrangement.

In order to explain the sequence in which the x-rays are emitted and how the diaphragms are moved, the 52 focal spots B1 through B52 of a quadratic multi-beam x-ray tube are shown in a plan view in FIG. 4. The focal spots B1, B9, B17, B25, B33, B41, B49, B5, B13, B21, B29, B37 and B45 thereby form the first square side; the focal spots B2, B10, B18, B26, B34, B42, B50, B6, B14, B22, B30, B38 and B46 form the second square side; the focal spots B3, B11, B19, B27, B35, B43, B51, B7, B15, B23, B31, B29 and B47 form the third square side; and the focal spots B4, B12, B20, B28, B36, B44, B52, B8, B16, B24, B32, B40, B48 form the fourth square side. For tomosynthesis, 52 individual images are acquired with 52 different focal spots B1 through B52. The cross section of the x-ray beam emitted from one of the focal spots B1 through B52 is restricted by two pairs of first diaphragm apertures 4A and 4B, 4D, of the two opposite first diaphragms (the diaphragm plates not being shown for clarity). The image series speed is limited by the maximum movement speed of the first diaphragm 1. Via the arrangement and the associated x-ray controller, the image series speed can be increased by a factor of 8. For this purpose, the focal spots B1 through B52 are bombarded with electron beams not in the successive sequence according to the spatial arrangement, but rather in a sequence controlled (designated) by the control unit. Since the first diaphragms respectively possess two first diaphragm apertures 4A through 4D, in each "rotation" the bombardment can "jump" between the two diaphragm apertures 4A, 4B or, respectively, 4C, 4D. In FIG. 4, for clarity only the center axes of the first diaphragm apertures 4A through 4C at the points in time t0 through t8 are shown as lines. The first diaphragm apertures of the two other first diaphragms are not drawn. The separation of the two first diaphragm apertures 4A, 4B or, respectively, 4C, 4D is equal to 6.5 times the focal spot separation. The image series frequency can thus be doubled via two first diaphragm apertures in a first diaphragm. In that a focal spot of a different square side is always activated in a round robin manner, the image series frequency can be quadrupled again. The first diaphragm thus has a "cycle" time in order to drive into a new position over the next focal spot. Only the first diaphragm through whose first diaphragm aperture 4A through 4D the x-ray beam is fired is at rest. Therefore the diaphragm moves ⅛ of a focal spot separation further between every new "shot".

The multi-beam x-ray device according to the invention can advantageously be used for a tomosynthesis in mammography. With the arrangement described above, 52 slice images can be acquired in the shortest possible time and be processed into a new spatial view.

A further preferred application is x-ray image acquisition in the operating room where movements of x-ray systems are disruptive. With the device according to the invention, x-ray radiator and x-ray detector remain at rest.

Although modifications and changes may be suggested by those skilled in the art, it is the intention of the inventor to embody within the patent warranted hereon all changes and modifications as reasonably and properly come within the scope of his contribution to the art.

I claim as my invention:

1. A multi-beam x-ray device, comprising:

a multi-beam x-ray tube having an interior polygonal shape consisting of a plurality of polygon sides, with a plurality of focal spots, from which x-rays are respectively emitted, located at each of said polygon sides;

an x-ray tube control unit that controls emission of x-rays from said multi-beam x-ray tube by activating emission of x-rays from individual ones of said focal spots to cause an x-ray beam alternating from polygon side-to-polygon side in a specified sequence; and a plurality of x-ray beam diaphragms located relative to said multi-beam x-ray tube respectively at said polygon sides, each of said diaphragms comprising a diaphragm plate having a diaphragm aperture therein that limits the respective x-ray beams emitted from the respective focal spots at the polygon side at which the diaphragm is located, and a displacement unit also controlled by said x-ray tube control unit to displace the respective diaphragm plates to place one of the respective diaphragm apertures in a path of x-rays emitted by a currently-activated focal spot at the polygon side at which the diaphragm is located, to produce said x-ray beam.

2. A multi-beam x-ray device as claimed in claim 1 comprising an x-ray image receiver that detects the x-ray beams emitted from the respective focal spots of the multi-beam x-ray tube, said x-ray image receiver being fixed relative to said multi-beam x-ray tube and each diaphragm overlying said x-ray image receiver.

3. A multi-beam x-ray device as claimed in claim 1 wherein each diaphragm has an individual displacement unit connected thereto, and wherein said control unit is configured to control the displacement units of the respective diaphragms to cause a diaphragm plate in front of a currently-activated focal spot to be at rest, while simultaneously moving at least one other diaphragm plate at another of said polygon sides to a position in front of a focal spot to be subsequently activated in said specified sequence.

4. A multi-beam x-ray device as claimed in claim 1 wherein each of said diaphragm plates is a first diaphragm plate that has two first diaphragm plate apertures therein, and wherein said displacement unit is operated by said control unit to place one of said two first diaphragm apertures in the path of the x-ray beam emitted by the currently-activated focal spot, and each diaphragm comprising a second diaphragm plate that covers the diaphragm aperture in the first diaphragm plate that is not in the path of the x-ray beam emitted by the currently-activated focal spot.

5. A multi-beam x-ray device as claimed in claim 4 comprising N focal spots, and wherein said focal spots are located at each polygon side with a uniform spacing between neighboring focal spots, and wherein said diaphragm apertures in each first diaphragm plate are spaced from each other by a plate spacing that is n.5 times the spacing between neighboring focal spots, wherein $n \in N$.

6. A multi-beam x-ray device as claimed in claim 1 wherein said polygon is a regular, planar polygon.

7. A multi-beam x-ray device as claimed in claim 1 wherein said control unit is configured to activate said focal spots and said displacement units in a sequence that causes a tomosynthetic image to be generated upon detection of the respective x-ray beams from the respective focal spots.

* * * * *